US006776643B2

(12) United States Patent
Nakano

(10) Patent No.: US 6,776,643 B2
(45) Date of Patent: Aug. 17, 2004

(54) SOCKET FOR ELECTRONIC ELEMENT

(75) Inventor: Kazunori Nakano, Yokkaichi (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 10/187,624

(22) Filed: Jul. 3, 2002

(65) Prior Publication Data

US 2003/0008544 A1 Jan. 9, 2003

(30) Foreign Application Priority Data

Jul. 4, 2001 (JP) ..... 2001-203790

(51) Int. Cl.[7] ..... H01R 11/22
(52) U.S. Cl. ..... 439/342; 439/266; 439/330
(58) Field of Search ..... 439/342, 266, 439/330, 331

(56) References Cited

U.S. PATENT DOCUMENTS 5,611,705 A * 3/1997 Pfaff ..... 439/266
6,149,449 A * 11/2000 Abe ..... 439/268
6,261,114 B1 * 7/2001 Shimada ..... 439/266
6,296,504 B1 * 10/2001 Ohashi ..... 439/266
6,371,782 B1 * 4/2002 Ohashi ..... 439/266
6,371,783 B1 * 4/2002 Ohashi et al. ..... 439/268
6,383,002 B1 * 5/2002 Ohashi ..... 439/259

FOREIGN PATENT DOCUMENTS

JP 2001-43947 2/2001

* cited by examiner

*Primary Examiner*—Michael C. Zarroli
(74) *Attorney, Agent, or Firm*—Finnegan, Henderson, Farabow, Garrett & Dunner, LLP

(57) ABSTRACT

The socket of the present invention includes a base, a plurality of contacts, a contact moving member slidably supported on the base, a cover allowing the contact moving member to slide on the base, a guiding member for holding an IC package and a swaying mechanism. The guiding member is movably supported on the contact moving member. The swaying mechanism sways the guiding member when the operating member is moved with respect to the base so that the contact moving member slides on the base.

13 Claims, 9 Drawing Sheets

SOCKET FOR ELECTRONIC ELEMENT

This application is based on Patent Application No. 2001-203790 filed Jul. 4, 2001 in Japan, the content of which is incorporated hereinto by reference.

BACKGROUND OF THE INVENTION

1. Field of the Invention

The present invention relates to a socket for electronic element such as an IC package, a semiconductor device or the like, and in particular to a socket for electronic element including contacts for the electrical connection with the external terminals of the electronic element.

2. Description of the Related Art

In general, an IC package for various kinds of electronic apparatuses is inserted into an IC socket for the purpose of carrying out a burn-in and reliability test before its shipment. The IC socket to be used for such a test generally includes a base and a plurality of contacts arranged on the base. Each of the contacts includes a pair of contact pieces which can approach and separate with respect to each other.

Some IC sockets used for the test have a contact opening function for electrically connecting contacts of the socket with package terminals (solder balls) and releasing the electric connection between the contacts and the terminals of the package. For example, Japanese Patent Application Laid-Open No. 2001-043947 discloses a conventional IC socket having a contact opening function.

In this IC socket, a plurality of contacts are arranged in a grid pattern on a generally rectangular socket body. The IC socket includes an operating member (cover) movable in a vertical direction with respect to the base and a sliding plate slidable in the direction in which a pair of contact pieces approach and separate with respect to each other. The operating member is urged by means of springs disposed between the base and the operating member. The sliding plate has a plurality of contact displacement portions respectively located between the contact pieces of each contact. The sliding plate includes an inclined plane and the operating member includes rollers which roll on the inclined plane of the sliding plate.

When the operating member is pushed down toward the base, the roller of the operating member rolls on the inclined plane of the sliding plate, thereby causing the sliding plate to slide on the base. As the sliding plate slides on the base, one of the contact pieces of each contact is displaced by each contact displacing portion of the sliding plate against its elasticity. As a result, the gap between contact pieces is enlarged (i.e., contact pieces are opened) so that each external terminal of the IC package can be inserted between the contact pieces of each contact.

When the push-down of the operating member is released, the operating member is moved upward by the restoring force of the spring, thereby allowing the sliding plate to slide on the base to return to its original position. The elastically displaced contact piece restores its original state to hold the corresponding external terminal of the IC package in cooperation with an opposite contact piece. As a result, each of the contacts of the socket is electrically connected with the corresponding external terminal of the IC package. When removing the IC package from the socket, the operating member is pushed down again toward the base.

In the case when the burn-in and reliability test is carried out using the above described conventional socket, however, some of the contacts of the socket may stick to the external terminals which have been heated and softened. In such a case, the contact cannot be separated from the bump only by sliding the sliding plate by means of the operating member. Attempting to forcibly separate the contact from the bump may result in damage to the contact and the IC package itself. As described above, the conventional socket encumbers stable and reliable production of the IC package. Accordingly, there is a requirement for an IC socket enabling the IC package to be removed easily without causing any damage to the contacts and the IC package after the burn-in and the reliability test.

SUMMARY OF THE INVENTION

A socket of the present invention which can removably hold various electronic elements comprises: a base; a plurality of contacts arranged in the base, each of the contacts having a pair of contact pieces which can approach and separate with respect to each other in a first direction; a contact moving member slidably supported on the base and having a plurality of contact displacing portions respectively located between the contact pieces of each contact; an operating member allowing the contact moving member to slide on the base in the first direction, the operating member being capable of moving with respect to the base; a guiding member having a package guide for supporting the electronic elements; and a swaying mechanism for swaying the guiding member in response to the movement of the operating member.

The above and other objects, effects, features and advantages of the present invention will become more apparent from the following description of embodiments thereof taken in conjunction with the accompanying drawings.

DETAILED DESCRIPTION OF PREFERRED EMBODIMENT

Figure 1:
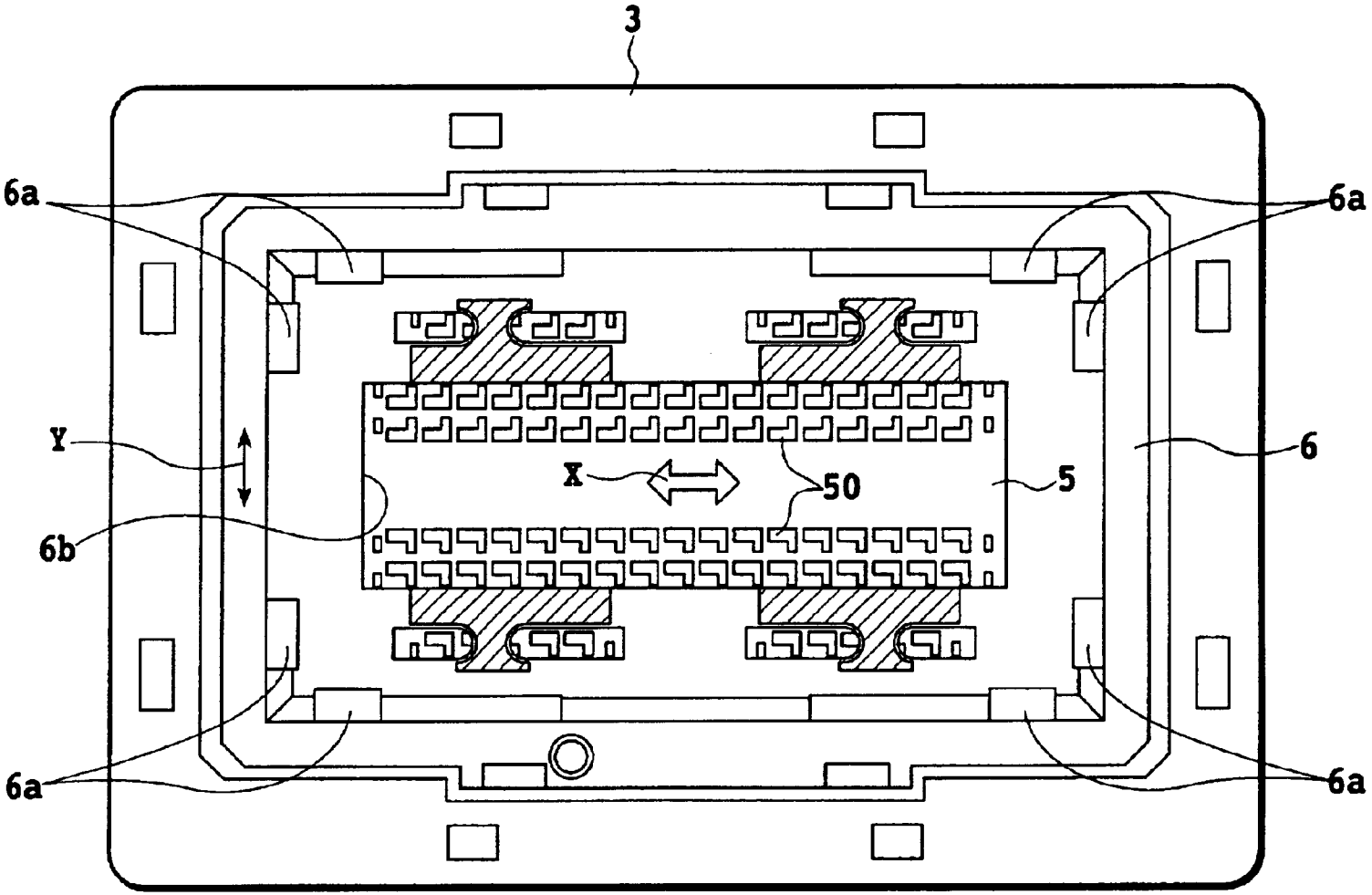
FIG. 1 is a plan view showing an embodiment of the socket according to the present invention.

In the socket of the present invention, the contact moving member can be slid on the base in the first direction by moving the operating member with respect to the base. The sliding movement of the contact moving member causes one of the contact pieces of each contact to be displaced against the elasticity thereof. This allows the gap between contact pieces to be enlarged (i.e., contact pieces are opened) so that each external terminal of the electronic element on the guiding member can be inserted between the contact pieces of each contact. Further, when the contact moving member returns to its original position, the contact piece, which has been elastically displaced, returns to its original position to hold the corresponding external terminal of the electronic element in cooperation with the opposite contact piece. To remove the electronic element from the socket, the operating member is moved again with respect to the base.

In this kind of socket, the contacts of the socket may stick to the external terminals of the electronic element which are heated and softened during the burn-in and the reliability test. In order to prevent this problem, the socket according to the present invention includes the swaying mechanism. The swaying mechanism is adapted to sway the guiding member which holds the electronic element in response to the movement of the operating member with respect to the base. Therefore, the contacts can be easily separated from the external terminals of the IC package only by moving the operating member without applying an excessive force to the contacts and the external terminals of the electronic element. Thus, the socket of the present invention enables the electronic element to be removed easily after the burn-in and the reliability test without damaging the contacts and the IC package itself, thereby facilitating a production of the IC packages.

Preferably, the swaying mechanism is adapted to sway the guiding member in the second direction substantially perpendicular to the first direction.

Preferably, the swaying mechanism includes a projection formed in the operating member, a projection formed in the guiding member to come into contact with the projection of the operating member, a guide way and a pin. The guide way is formed in one of the contact moving member and the guiding member. The pin is formed in the other of the contact moving member and the guiding member so as to engage with the guide way of the contact moving member or the guiding member.

Preferably, the guide way is defined by a first wall and a second wall which are opposite to each other. The first wall includes a projecting portion projecting substantially in the second direction and the second wall includes a depressed portion opposite to the projection of the first wall.

Preferably, the socket of the present invention is adapted to hold an IC package of a ball grid array type.

Preferably, the socket of the present invention is an open-top type socket and its operating member is a cover movable substantially in the vertical direction with respect to the base.

FIGS. 1 to 9 show the preferred embodiments of the socket according to the present invention. The IC socket 1 shown in these drawings is capable of removably holding an IC package 100 (see FIGS. 2 and 6). The IC package 100 includes a plurality of substantially hemispheric bumps (solder balls) 101 serving as the external terminals.

Figure 3:
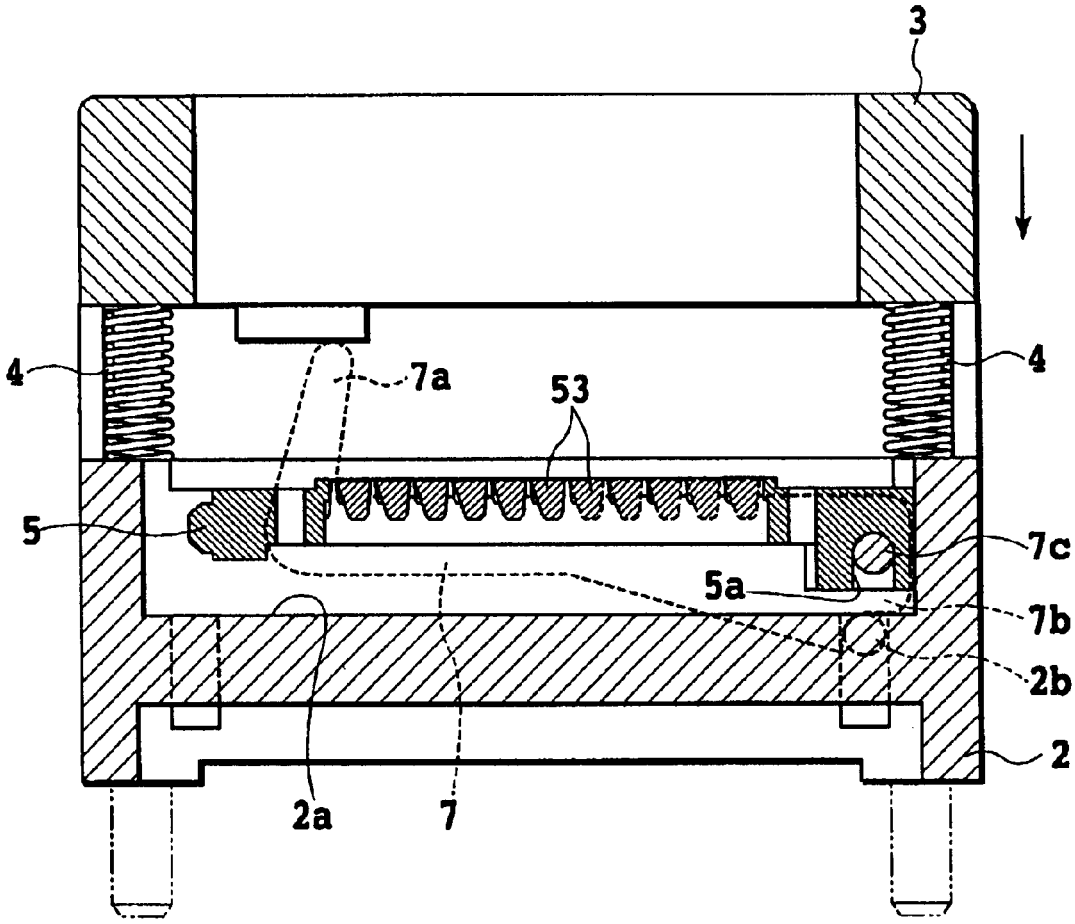
FIG. 3 is a partially sectional view of the socket shown in FIG. 1.

The socket is a so-called open-top type socket which includes a base 2 and a cover 3 (operating member). The cover 3 is supported so as to be movable in the vertical direction with respect to the base 2. A plurality of springs 4 are disposed between the base 2 and the cover 3 as shown in FIG. 3. The cover 3 is urged upward by the springs 4. The cover 3 is connected to a package pushing members or a pusher (not shown). The package pushing members push the IC package 100 downward against the base 2.

Figure 2:
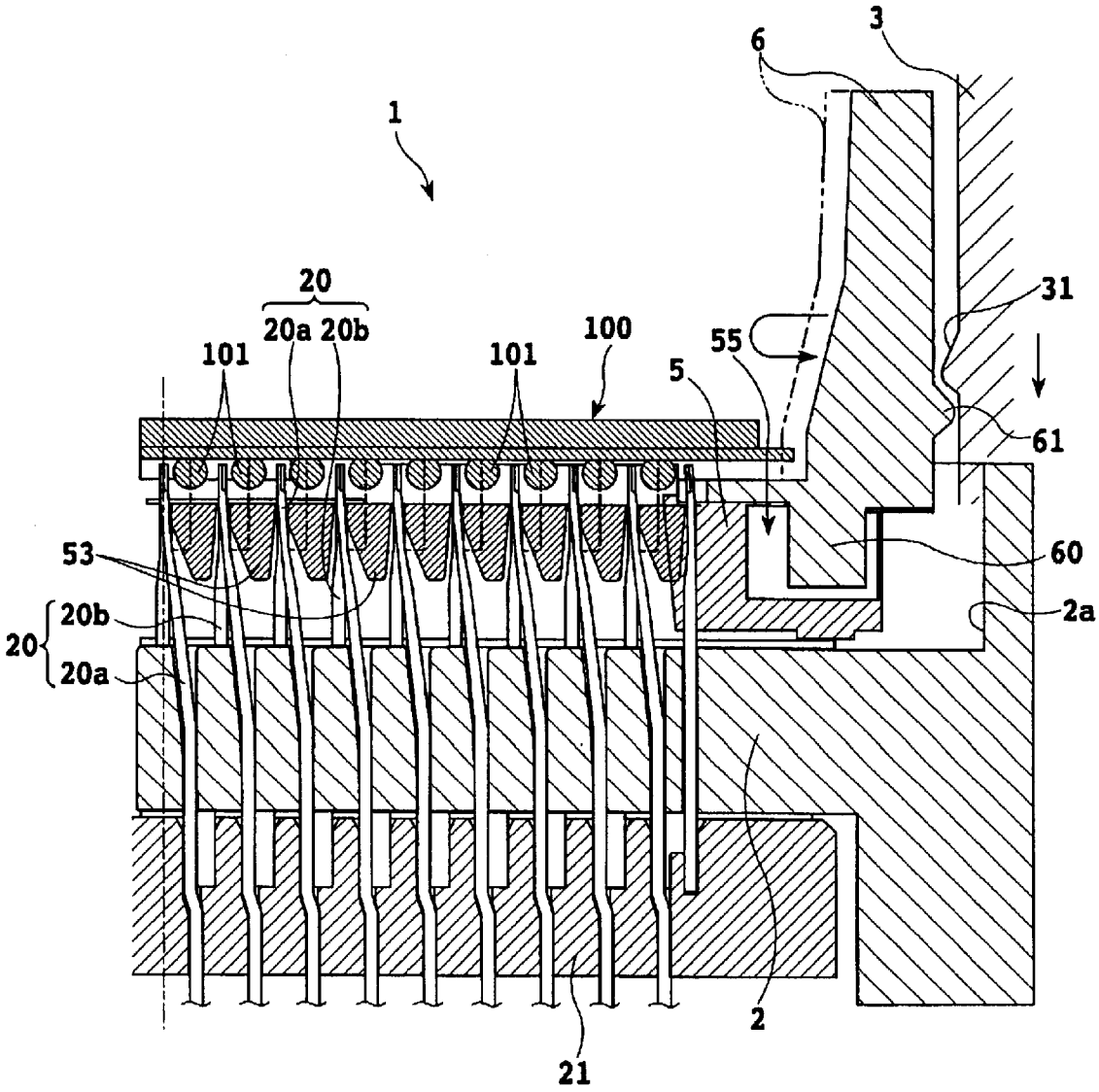
FIG. 2 is an enlarged sectional view of the socket shown in FIG. 1.

As shown in FIG. 2, the socket 1 includes a plurality of contacts 20 arranged in the base 2, the contact moving member 5 slidably supported in chamber 2*a* of the base 2, and the guiding member 6 supported so as to slide horizontally on the contact moving member 5. The contacts 20 are respectively attached to arrangement board 21 so as to correspond to an array of bumps 101 of the IC package 100. The arranging board 21 is mounted to the base 2 so that the contacts 20 respectively project upward through the openings formed in the base 2. The contact moving member 5 is capable of sliding horizontally within the chamber 2*a* in the direction (X-direction) indicated with an arrow in FIG. 1. The contact moving member 5 has a plurality of openings 50 arranged to correspond to the array of the bumps 101 of the IC package 100. Further, the guiding member 6 includes a package guide 6*a* and a substantially rectangular opening 6*b* as shown in FIG. 1.

Each of contacts 20 includes a movable contact piece 20*a* and a stationary contact piece 20*b* which are respectively made of an elastic material. The movable contact piece 20*a* and the stationary contact piece 20*b* of each contact can approach and separate with respect to each other in the moving direction (first direction) of the contact moving member 5. The movable contact piece 20*a* and the stationary contact piece 20*b* of each contact respectively project upward through the corresponding opening 50 of the contact moving member 5 and through the opening 6*b* of the guiding member 6. The movable contact piece 20*a* and the stationary contact piece 20*b* can hold the corresponding bump 101 of the IC package 100 positioned in the guiding member 6, thereby achieving an electrical connection between the contacts 20 and the bumps 101.

Figure 4:
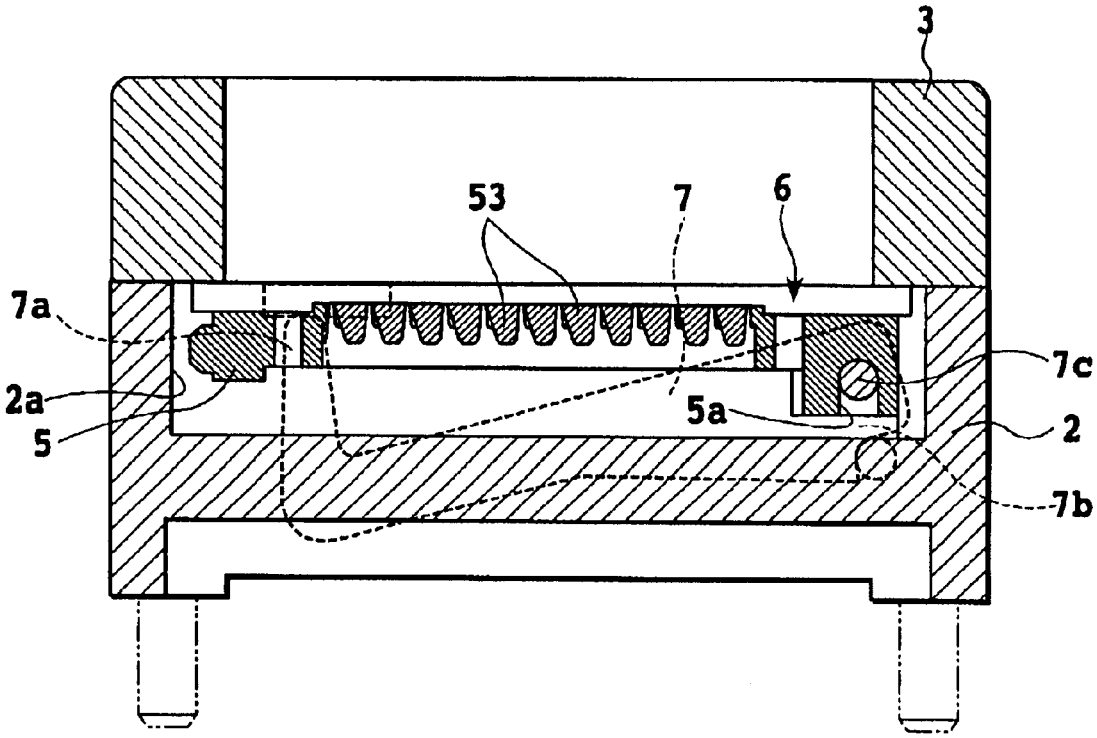
FIG. 4 is a partially sectional view similar to that of FIG. 3 showing the socket of FIG. 1.

FIGS. 3 and 4 respectively show the mechanism for allowing the contact moving member 5 to move within the chamber 2*a*. This mechanism includes a lever 7 having a tip portion 7*a* which can touch the cover 3, a base portion 7*b* pivotally supported by a supporting shaft 2*b* which is secured to the base 2, and a driving pin 7*c* secured to the base portion 7*b*. Further, a slot 5*a* is formed in one end (the right end in FIGS. 3 and 4) of the contact moving member 5, which engages with a drive pin 7*c* of the lever 7.

When the cover 3 is moved downward with respect to the base 2 against the force of springs 4 in the free state shown in FIG. 3, the front end 7*a* of the lever 7 is pushed down by the cover 3 so that the lever 7 is pivotally moved about the supporting shaft 2*b* in a counterclockwise direction in FIG. 3. With the pivotal movement of the lever 7, the drive pin 7*c* of the base member 7*b* travels toward the left side in FIGS. 3 and 4, thereby causing the contact moving member 5 to move horizontally within the chamber 2*a* toward the left side in FIGS. 2 and 4.

Figure 5A:
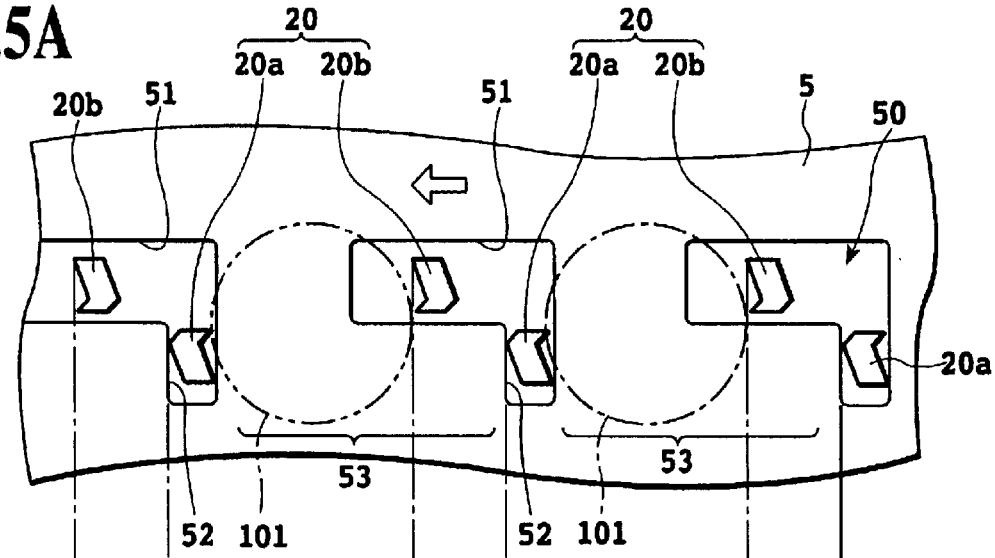
FIG. 5A is a schematic diagram illustrating the relationship between the contact and the contact moving member with the operating member being in free state.
Figure 5B:
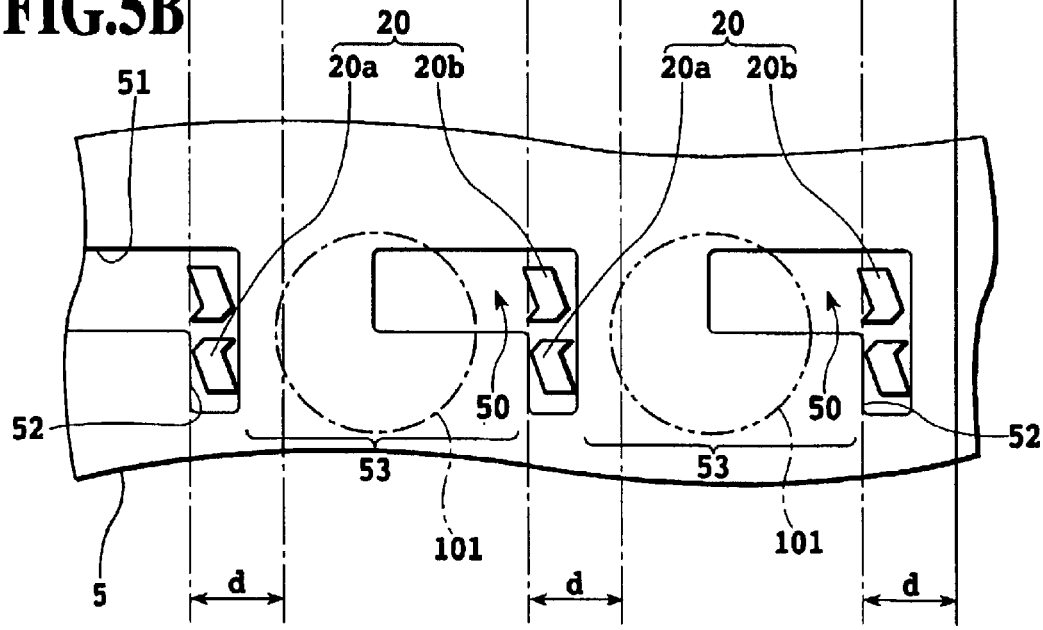
FIG. 5B is a schematic diagram illustrating the relationship between the contact and the contact moving member with the operating member pushed down.
Figure 6:
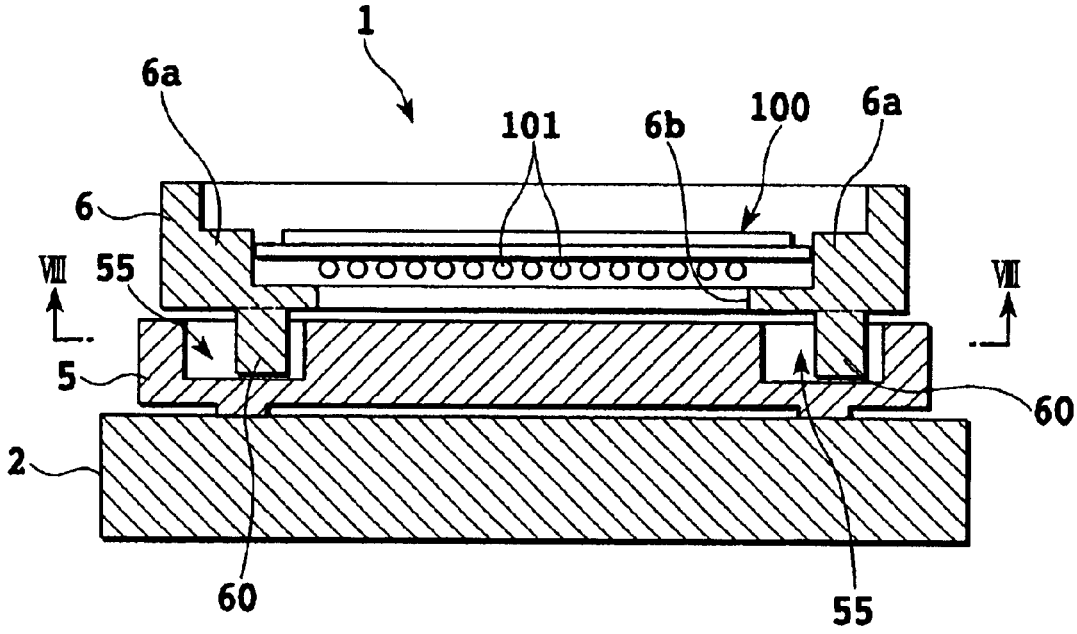
FIG. 6 is a longitudinally sectional view of the IC socket of FIG. 1.
Figure 7:
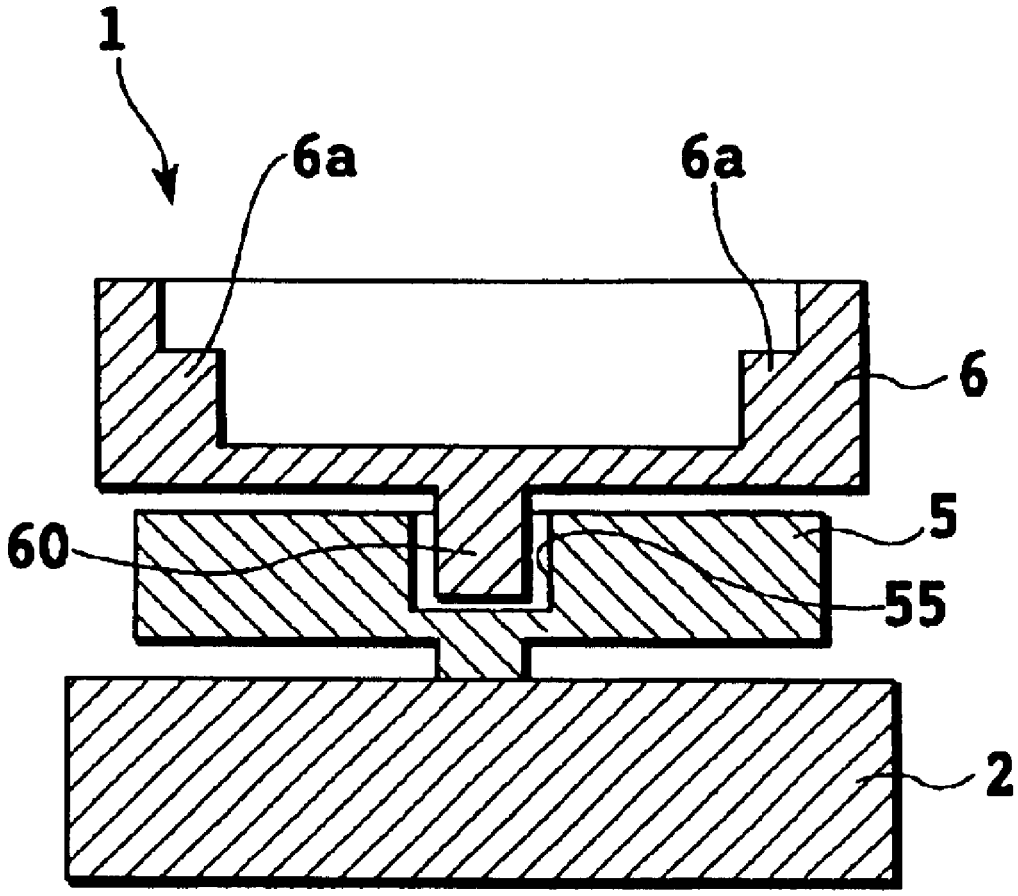
FIG. 7 is a sectional view of the IC socket of FIG. 1.
Figure 8:
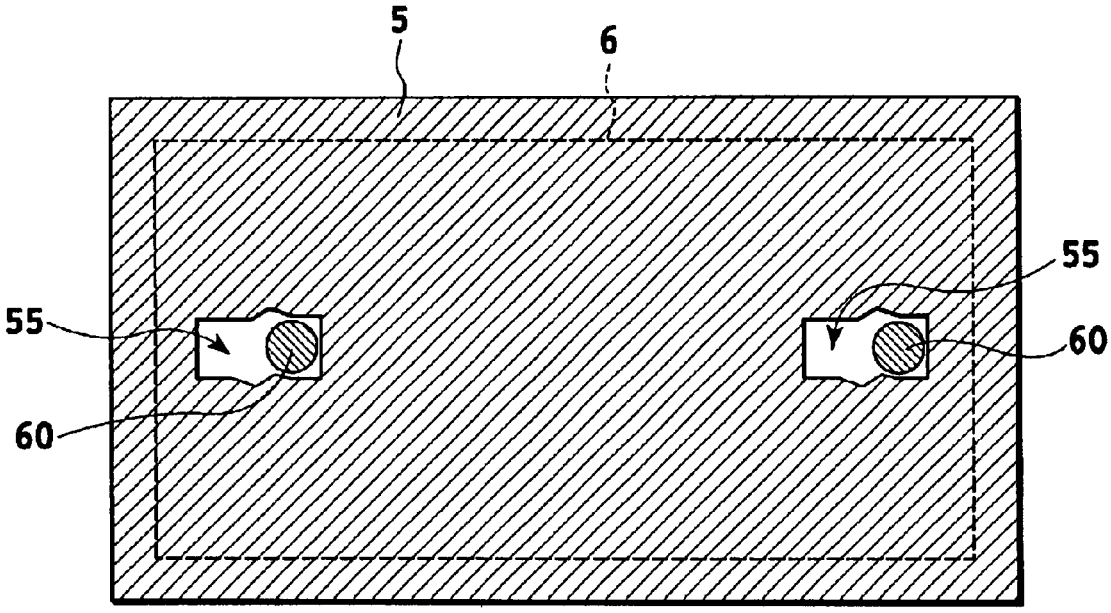
FIG. 8 is a sectional view taken along VIII-VIII line of FIG. 6.

In this embodiment, as shown in FIGS. 5A and 5B, the openings 50 of the contact moving member 5 are formed substantially in an L-shape. The opening 50 includes an elongated hole 51 extending in the moving direction of the contact moving member 5 and a short hole 52 substantially perpendicular to the elongated hole 51. The movable contact piece 20*a* of one contact is inserted into the short hole 52 of a corresponding opening 50. The stationary contact piece 20*b* of the contact is inserted into the elongated hole 51 adjacent to the opening 52 into which the movable contact piece 20*a* is inserted. Further, the portion of the contact moving member 5 located between the openings 50 which are adjacent to each other serves as a contact displacing portion 53 for displacing the movable contact piece 20*a* of each contact. That is, the contact displacing portion 53 of the contact moving member 5 is positioned between the movable contact piece 20*a* and the stationary contact piece 20*b* of one contact 20.

In this embodiment, as shown in FIGS. 5A and 5B, the movable contact piece 20*a* and the stationary contact piece 20*b* are shifted from each other in the direction substantially perpendicular to the moving direction of the contact moving member 5. This arrangement allows increasing the density of the contacts 20 in IC socket 1.

When the cover 3 (operating member) is in free state as in FIG. 3, that is, when the contact moving member 5 has not been moved by the lever 7 or the like, the movable contact piece 20*a* and the stationary contact piece 20*b* of each contact are close to each other as shown in FIG. 5A. On the other hand, when the cover 3 is pushed down toward the base 2 to move the contact moving member 5 in the direction indicated with an arrow as in FIG. 5A, the movable contact piece 20*a* of each contact is separated from the stationary contact piece 20*b* by means of each contact displacing portion 53 of the contact moving member 5 by the distance "d" of FIG. 5B. As a result, each contact 20 is opened so that each bump can be inserted between contact pieces 20*a* and 20*b* of each contact. When the push-down of the cover 3 is released, the contact moving member 5 returns to the state shown in FIG. 5A so that each pair of contact pieces 20*a* and 20*b* are again close to each other.

Figure 9:
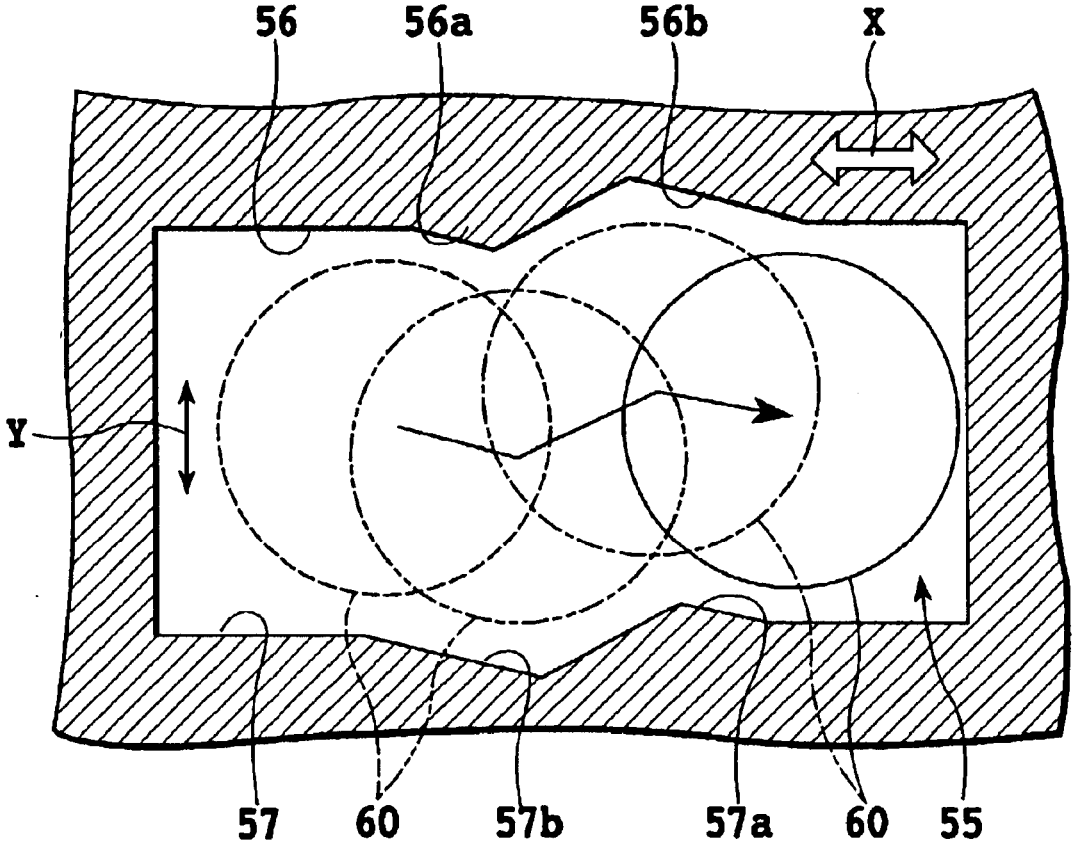
FIG. 9 is schematic diagram illustrating the relationship between the guide way of the contact moving member and the pin of the guiding member.

Now, in the socket 1 of the present invention, the guiding member 6 for holding the IC package 100 is movably supported on the contact moving member 5. More particularly, the contact moving member 5 includes two guide ways 55 which extends substantially in parallel with the moving direction of the contact moving member 5 as shown in FIGS. 6 to 9. The guide way 55, as shown in FIG. 9, is defined by two walls 56 and 57 which are opposite to each other. One wall 56 includes a projecting portion 56 projecting in Y-direction (the second direction) substantially perpendicular to the moving direction X of the contact moving member 5 and a depressed portion 56*b* adjacent to the projecting portion 56*a*. The X-direction corresponds to the direction in which the contact pieces 20*a* and 20*b* of each contact 20 approaches and separates from each other. On the other hand, the other wall 57 includes a projecting portion 57*a* which projects in Y-direction to be opposite to the depressed portion 56*b* of the wall 56 and a depressed portion 57*b* opposite to the projecting portion 56*a* of the wall 56.

The guiding member 6 includes two pins 60 respectively projecting downward from the bottom of the guiding member 6. Each of the pins 60 is inserted into corresponding guide way 55 of the contact moving member 5. Further, as shown in FIG. 2, the guiding member 6 includes a projection 61 projecting outward from the side surface of the guide member. The cover 3 is formed to surround the guiding member 6 and includes a projection 31 which can be in contact with the projection 61 of the guiding member 6 on its internal surface. The guide way 55, the pins 60, the projection 61 of the guiding member 6 and the projection 31 of the cover 3 constitute a swaying mechanism.

In the socket 1 of the present invention, in order to remove the IC package 100 from the guiding member 6, the cover 3 is pushed down towards the base 2 so as to enlarge the gap between the contact pieces 20*a* and 20*b* of each contact 20. As the cover 3 is pushed down towards the base 2, as seen from FIG. 2, the projection 31 of the cover 3 and the projection 61 of the guiding member 6 eventually come into contact with each other. Then, the cover 3 is further pushed down so that the projection 31 overrides the projection 61, thereby causing the guiding member 6 to slide in the X-direction with respect to the contact moving member 5 (and the base 2).

As shown in FIG. 9, the pin 60 of the guiding member 6 moves within the guide way 55 from the position indicated by the solid line to the position indicated by the broken line until the projection 31 of the cover 3 overrides the projection 61 of the guiding member 6. The pin 60 is laterally pushed by the projecting portion 57*a* of the wall 57 and the projecting portion 56*a* of the wall 56 while moving within the guide way 55. As a result, the guiding member 6 holding the IC package 100 is swayed in Y-direction of FIGS. 1 and 9 with respect to the contact moving member 5 (and the base 2). When the projection 31 of the cover 3 has overridden the projection 61 of the guiding member 6, the guiding member 6 slides in the X-direction with respect to the contact moving member 5 (and the base 2) to return to its original position. During this movement, the pin 60 is also laterally pushed by the projecting portion 56*a* of the wall 56 and the projecting portion 57*a* of the wall 57. As a result, the guiding member 6 holding the IC package 100 is swayed in the Y-direction with respect to the contact moving member 5 (and the base 2) as shown in FIG. 9.

As described above, the socket 1 of the present invention includes the swaying mechanism comprising the guide way 55, the pin 60, the projection 61 of the guiding member 6 and the projection 31. The swaying mechanism moves the guiding member 6 in the X-direction (the first direction) with respect to the contact moving member 5 (and the base 2) and also sways the guiding member 6 in the Y-direction (the second direction) while the guiding member 6 moves in the X-direction. As a result, even if the contacts 20 stick to bumps 101 of the IC package which are heated and softened during the burn-in and the reliability test, the contacts 20 can be easily separated from the bumps 101 only by pushing down the cover 3 without applying an excessive force to the contacts 20 (contact pieces 20*a* and 20*b*) and the bumps 101 of the IC package. Thus, the socket 1 of the present invention enables the IC package 100 to be removed easily without damaging the contact 20 and the IC package (the bump 101) itself, thereby achieving a stable, automated and efficient production of the IC package.

As described above, the guide way 55 is formed in the contact moving member 5 and the pin 60 engaging with the guide way 55 is formed in the guiding member 6, however, the present invention is not limited to this. Alternatively, the guide way may be formed in the guiding member 6 and the pin 60 engaging with the guide way 55 may be formed in the contact moving member 5. Further, instead of the projection 31 of the cover 3 and the projection 61 of the guiding member 6, the socket 1 may include a cam mechanism for moving the guiding member 6 with respect to the contact moving member 5.

Further, the socket of the present invention may be adapted to hold the IC package other than the ball grid array type. Of course, the present invention is also applicable to a clamshell type socket.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A socket capable of removably holding various electronic elements comprising:

a generally rectangular base having sidewalls;

a plurality of contacts arranged in said base, each of said contacts having a pair of contact pieces which can approach and separate with respect to each other in a manner determined by a guide way, said guide way having a first direction being parallel with one of said sidewalls of said base;

a contact moving member slidably supported on said base and having a plurality of contact displacing portions respectively located between said contact pieces of each contact;

an operating member allowing said contact moving member to slide on said base in a manner determined by said guide way, said operating member being capable of moving with respect to said base;

a guiding member having a package guide for supporting said electronic elements; and a swaying mechanism for swaying said guiding member in response to the movement of said operating member;

wherein said guide way includes changes in direction.

2. The socket as claimed in claim 1, wherein said swaying mechanism is adapted to sway said guiding member in a second direction substantially perpendicular to said first direction.

3. The socket as claimed in claim 2, wherein said swaying mechanism includes a projection formed in said operating member, a projection formed in said guiding member to come into contact with said projection of said operating member, the guide way formed in said contact moving member and a pin formed in said guiding member, said pin engaging with said guide way of said contact moving member.

4. The socket as claimed in claim 3, wherein said guide way is defined by a first wall and a second wall which are opposite to each other, said first wall including a projecting portion projecting substantially in said second direction and said second wall including a depressed portion opposite to said projecting portion of said first wall.

5. The socket as claimed in claim 2, wherein said swaying mechanism includes a projection formed in said operating member, a projection formed in said guiding member to come into contact with said projection of said operating member, the guide way formed in said guiding member and a pin formed in said contact moving member, said pin engaging with said guide way of said guiding member.

6. The socket as claimed in claim 5, wherein said guide way is defined by a first wall and a second wall which are opposite to each other, said first wall including a projecting portion projecting substantially in said second direction and said second wall including a depressed portion opposite to said projecting portion of said first wall.

7. The socket as claimed in claim 1, wherein said socket is adapted to hold an IC package of a ball grid array type.

8. The socket as claimed in claim 1, wherein said socket is an open-top type socket and said operating member is a cover movable substantially in vertical direction with respect to the base.

9. A socket capable of removably holding various electronic elements comprising:

a base;

a plurality of contacts arranged in said base, each of said contacts having a pair of contact pieces which can approach and separate with respect to each other in a first direction;

a contact moving member slidably supported on said base and having a plurality of contact displacing portions respectively located between said contact pieces of each contact;

an operating member allowing said contact moving member to slide on said base in said first direction, said operating member being capable of moving with respect to said base;

a guiding member having a package guide for supporting said electronic elements; and a swaying mechanism for swaying said guiding member in response to the movement of said operating member, wherein said swaying mechanism is adapted to sway said guiding member in a second direction substantially perpendicular to said first direction.

10. The socket as claimed in claim 9, wherein said swaying mechanism includes a projection formed in said operating member, a projection formed in said guiding member to come into contact with said projection of said operating member, a guide way formed in said contact moving member and a pin formed in said guiding member, said pin engaging with said guide way of said contact moving member.

11. The socket as claimed in claim 10, wherein said guide way is defined by a first wall and a second wall which are opposite to each other, said first wall including a projecting portion projecting substantially in said second direction and said second wall including a depressed portion opposite to said projecting portion of said first wall.

12. The socket as claimed in claim 9, wherein said swaying mechanism includes a projection formed in said operating member, a projection formed in said guiding member to come into contact with said projection of said operating member, a guide way formed in said guiding member and a pin formed in said contact moving member, said pin engaging with said guide way of said guiding member.

13. The socket as claimed in claim 11, wherein said guide way is defined by a first wall and a second wall which are opposite to each other, said first wall including a projecting portion projecting substantially in said second direction and said second wall including a depressed portion opposite to said projecting portion of said first wall.

* * * * *